US007163006B2

(12) United States Patent
Sharman

(10) Patent No.: US 7,163,006 B2
(45) Date of Patent: Jan. 16, 2007

(54) RECIPROCATING PISTON INTERNAL COMBUSTION ENGINES

(75) Inventor: Greville George Sharman, West Sussex (GB)

(73) Assignee: J.C. Bamford Excavators Limited, Staffordshire (GB)

( * ) Notice: Subject to any disclaimer, the term of this patent is extended or adjusted under 35 U.S.C. 154(b) by 0 days.

(21) Appl. No.: 10/516,043

(22) PCT Filed: May 29, 2003

(86) PCT No.: PCT/GB03/02335

§ 371 (c)(1),
(2), (4) Date: May 26, 2005

(87) PCT Pub. No.: WO03/102388

PCT Pub. Date: Dec. 11, 2003

(65) Prior Publication Data

US 2005/0205072 A1 Sep. 22, 2005

(30) Foreign Application Priority Data

May 30, 2002 (GB) ..... 0212588.8

(51) Int. Cl.
*F01M 13/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 2,821,174 A | | 1/1958 | Scheiterlein | |
| 4,103,650 A | * | 8/1978 | Nishida et al. | 123/41.86 |
| 4,156,406 A | * | 5/1979 | Brandau et al. | 123/41.86 |
| 4,597,372 A | * | 7/1986 | Furukawa | 123/572 |
| 4,969,422 A | * | 11/1990 | Ishikawa et al. | 123/41.86 |
| 6,142,129 A | | 11/2000 | Hori et al. | |
| 6,213,107 B1 | * | 4/2001 | Gyllenstedt | 123/572 |
| 6,412,478 B1 | * | 7/2002 | Ruehlow et al. | 123/572 |
| 6,598,595 B1 | * | 7/2003 | Yasui | 123/572 |
| 6,779,516 B1 | * | 8/2004 | Shureb | 123/572 |
| 6,899,091 B1 | * | 5/2005 | Akiyama et al. | 123/572 |

FOREIGN PATENT DOCUMENTS

| | | |
|---|---|---|
| EP | 0810351 | 12/1997 |
| EP | 1149990 | 10/2001 |
| GB | 2260365 | 4/1993 |

* cited by examiner

*Primary Examiner*—Marguerite McMahon
(74) *Attorney, Agent, or Firm*—MacMillan, Sobanski & Todd, LLC

(57) ABSTRACT

An internal combustion engine includes a cylinder block (2) defining a plurality of cylinders (5) reciprocably accommodating respective pistons (7), which are connected by respective connecting rods (9) to a common crankshaft (11), which is accommodated in a crankcase. Each cylinder communicates with a common inlet manifold (21) via one or more inlet valves (19). The crankcase communicates with the inlet manifold via a pathway which includes a droplet separator comprising a labyrinthine pathway. The crankshaft (11) carries a drive gear (13), which is in mesh with a plurality of driven gears (15) accommodated in a gearcase (6), which is connected on one end of the cylinder block (2), whereby the crankcase and the gearcase have adjacent opposed surfaces. The labyrinthine pathway is defined at least in part by the said opposed surfaces of the crankcase and the gearcase.

12 Claims, 5 Drawing Sheets

RECIPROCATING PISTON INTERNAL COMBUSTION ENGINES

The invention relates to internal combustion engines of the type including a cylinder block defining a plurality of cylinders reciprocably accommodating respective pistons, which are connected by respective connecting rods to a common crankshaft, which is accommodated in a crankcase, each cylinder communicating with a common inlet manifold via one or more inlet valves, the crankcase communicating with the inlet manifold via a pathway which includes a droplet separator comprising a labyrinthine pathway, the crankshaft carrying a drive gear, which is in mesh with a plurality of driven gears accommodated in a gearcase, which is connected to one end of the cylinder block, whereby the crankcase and the gearcase have adjacent opposed surfaces.

When an internal combustion engine of reciprocating piston type is in operation, the pressurised gas within the cylinders tends to leak past the piston rings into the crankcase. Such leaking gases are known as blow-by gases. Such leakage can be on a substantial scale and can amount to as much as 100 to 120 litres per minute. This leakage tends to pressurise the crankcase and if any substantial pressure were permitted to build up in the crankcase, damage to the crankcase seals would inevitably occur. It is therefore well known to vent the crankcase to release this pressure. The blow-by gases contain a considerable amount of entrained droplets of unburnt or partially burnt fuel and also of oil and it is not acceptable for environmental reasons simply to vent these gases to the atmosphere. It is therefore known to provide a vent path which feeds the blow-by gases back to the engine inlet manifold so that the unburnt hydrocarbons contained therein are burnt. However, this results in a substantial wastage of crankcase lubricating oil and in the production of considerable additional exhaust emissions and smoke, which is now unacceptable. Furthermore, if the engine is provided with a turbocharger, the introduction of a significant amount of oil droplets into the inlet manifold upstream of the turbocharger compressor results in the turbocharger becoming coked up.

EP-A-0926319 discloses an engine in which the venting pathway between the crankcase and the engine inlet includes a labyrinthine separator. This is defined between the cylinder block and a separate cover secured to the block. It has, however, been found that this construction is not satisfactory because the provision of the separator on an external surface of the engine results in condensation forming within the separator and thus in an oil-water emulsion being formed which can clog the separator. Furthermore, the necessity of providing a separate cover increases the part count and thus expense of the engine. The labyrinthine separator is necessarily relatively short and it is found that its separation efficiency is inadequate whereby the problems referred to above still occur. Finally, the necessity with this construction of providing external tubing or pipework further increases the complexity and expense of the engine and increases the risk of oil eaks.

It is therefore the object of the invention to provide an engine of the type referred to above in which the problems referred to are eliminated or substantially reduced and the oil and the like entrained in the blow-by gases is substantially removed before the gases are introduced into the inlet manifold and are returned to the engine sump. It is a further object of the invention to achieve this result in a manner which does not increase the engine part count and thus does not significantly increase its overall expense.

In accordance with the present invention, an engine of the type referred to above is characterised in that the labyrinthine pathway is defined at least in part by the said opposed surfaces of the crankcase and the gearcase. Thus by appropriately shaping the opposed surfaces of the cylinder block and the gearcase, a labyrinthine separator can be provided which not only results in no increase in the part count of the engine but is also maintained substantially at engine operating temperature, whereby the problems associated with condensation are avoided.

Since the cylinder block and the gearcase are relatively large, it is relatively easy to make the labyrinthine separator of a length sufficient to achieve substantial removal of all the entrained oil droplets. In one embodiment of the invention, the labyrinthine droplet separator includes at least two elongate passage portions connected in series, the gas flow directions through the two passage portions being parallel but opposite. Thus the separator may include two connected passage portions, e.g. one above the other, thereby increasing the length and thus the efficiency of the separator.

It is preferred that the crankshaft also carries a flywheel, which is accommodated in a flywheel casing connected to the gearcase, and that the labyrinthine droplet separator is also defined in part between the flywheel casing and the gearcase. This permits a further increase in the length and thus separation efficiency of the droplet separator. In one embodiment of the invention, the droplet separator includes four passage portions connected in series, two of which are defined between the cylinder block and the gearcase and the other two of which are defined between the flywheel casing and the gearcase. It is preferred that the labyrinthine droplet separator communicates with the interior of the crankcase via one or more oil return holes formed in a gasket provided between the gearcase and the cylinder block and/or the flywheel casing. In a particularly simple and efficient embodiment, the gearcase affords two elongate undulating portions which define alternating peaks and troughs in two directions, that is to say in the direction both towards and away from the cylinder block, each undulating region partially defining a respective two of the four passage portions. Thus if a relatively thin portion of the gearcase is of undulating shape, it will afford peaks or ribs separated by troughs on both surfaces, both of which can be used to partially define one of the portions of the labyrinthine separator.

It is preferred that the interior of the crankcase communicates with the labyrinthine droplet separator via a hole in the crankcase which is positioned in registry with one of the gears, preferably one of the driven gears, therein. The regions behind the gears in the gearcase are relatively quiescent and the provision of the said hole in registry with the radial surface of one of the gears results in the gas flow impinging against that surface and a proportion of the entrained droplets coalescing against the surface and then dripping back down to the sump. This construction therefore includes an additional pre-separation stage which further enhances the separation efficiency.

In the engine referred to above, the labyrinthine pathway is defined between the crankcase and the gearcase and preferably also, if a flywheel casing is connected to the gearcase, between the gearcase and the flywheel casing. The gearcase and flywheel casing are thus both connected to the same end of the cylinder block. However, it is also possible for them to be connected to opposite ends of the cylinder block. In this event, the labyrinthine pathway may be defined only between the crankcase and the gearcase. However, it will be appreciated that it may also be defined only between the crankcase and the flywheel casing.

Thus according to a further aspect of the present invention, there is provided an internal combustion engine including a cylinder block defining a plurality of cylinders reciprocably accommodating respective pistons, which are connected by respective connecting rods to a common crankshaft, which is accommodated in a crankcase, each cylinder communicating with a common inlet manifold via a pathway which includes a droplet separator comprising a labyrinthine pathway, the crankshaft carrying a flywheel, which is accommodated in a flywheel casing, which is connected to one end of the cylinder block, whereby the crankcase and the flywheel casing have adjacent opposed surfaces, characterised in that the labyrinthine pathway is defined at least in part by the said opposed surfaces of the crankcase and the flywheel casing.

It will also be appreciated that, if a flywheel casing is connected to the gearcase, the labyrinthine pathway may be defined only between the gearcase and the flywheel casing.

Thus according to yet a further aspect of the present invention, there is provided an internal combustion engine including a cylinder block defining a plurality of cylinders reciprocably accommodating respective pistons, which are connected by respective connecting rods to a common crankshaft, which is accommodated in a crankcase, each cylinder communicating with a common inlet manifold via one or more inlet valves, the crankcase communicating with the inlet manifold via a pathway which includes a droplet separator comprising a labyrinthine pathway, the crankshaft carrying a drive gear, which is in mesh with a plurality of driven gears accommodated in a gearcase, which is connected to one end of the cylinder block, the crankshaft also carrying a flywheel accommodated in a flywheel casing, which is connected to the gearcase, whereby the flywheel casing and the gearcase have adjacent opposed surfaces, characterised in that the labyrinthine pathway is defined at least in part by the said opposed surfaces of the flywheel casing and the gearcase.

The labyrinthine separator described above may remove sufficient of the entrained droplets in the blow-by gases that they may then be returned directly to the inlet manifold. However, in a preferred embodiment, in which the separation efficiency is yet further enhanced, the inlet valves cooperate with respective rocker arms accommodated in a common rocker box closed by a cover and the blow-by gas pathway includes a further labyrinthine droplet separator which forms part of the cover. In one embodiment, the pathway communicates with the interior of the rocker box and formed in the rocker box cover is a trough, whose interior communicates with the interior of the rocker box and formed on the base of which is a plurality of upstanding ribs and received in which is a separator unit, the base of which together with the base of the trough defines a first gas passage and depending from the base of which is a plurality of ribs offset from the upstanding ribs, whereby the first gas passage is serpentine and constitutes at least part of the further labyrinthine droplet separator.

It is further preferred that the first gas passage communicates with the interior of the separator unit which defines a second gas passage, in which a plurality of baffles is so arranged that the second gas passage is also serpentine, the baffles in the second gas passage being inclined to the ribs in the first gas passage by substantially 90°.

Further features and details of the invention will be apparent from the following description of one specific embodiment of diesel engine in accordance with the invention which is given by way of example with reference to the accompanying drawings, in which.

Figure 1:
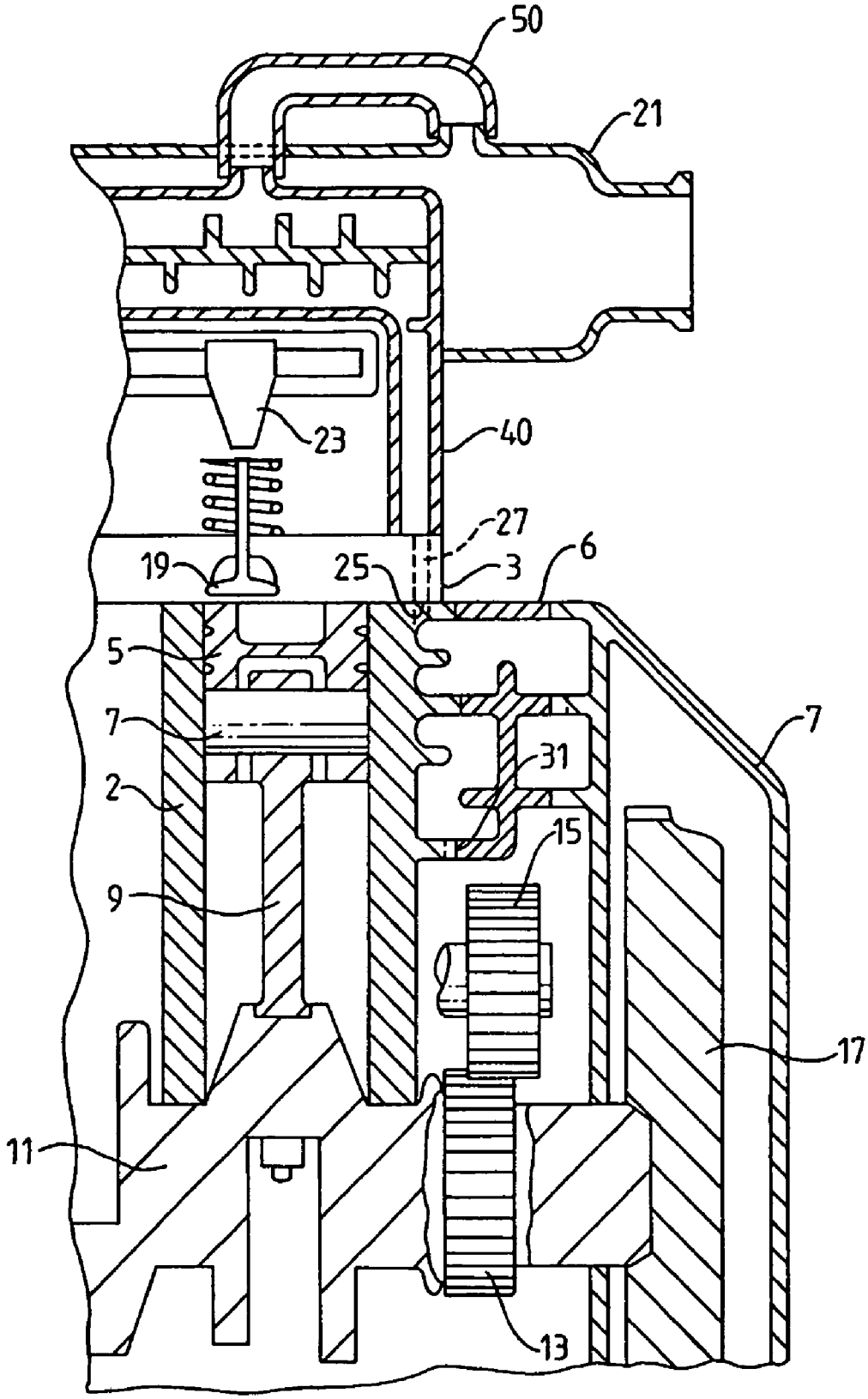
FIG. 1 is a schematic scrap longitudinal sectional view showing one of the engine.

As best seen in FIG. 1, the engine comprises a cylinder block 2 which is closed by a cylinder head 3 and defines a plurality of cylinders 5, each of which reciprocably accommodates a respective piston 7. The pistons are connected by respective connecting rods 9 to a common crankshaft 11 accommodated within a crankcase defined by the lower portion of the cylinder block. The crankshaft passes out of the rear surface of the cylinder block through a hole 4 (best seen in FIG. 2). Immediately behind the rear surface of the cylinder block, the crankshaft carries a drive gear 13 which is accommodated within a gear casing defined by the cylinder block 2 and a gearcase 6 connected thereto. Also accommodated within the gear casing is a plurality of driven gears, of which only one designated 15 is shown in FIG. 1. Each driven gear is in mesh directly or indirectly with the driven gear 13 and is connected to a respective auxiliary device, such as an oil pump, an alternator, an air-conditioning pump or the like so that the auxiliary devices are driven by the crankshaft.

The crankshaft 11 extends through the gearcase and at its free end carries a flywheel 17, which is accommodated in a flywheel casing 7 connected to the gearcase 6.

Each cylinder 5 has one or more inlet valves 19, which communicate with a common inlet manifold 21, and one or more exhaust valves (not shown), which communicate with a common exhaust manifold (also not shown). The inlet and exhaust valves are operated by respective cams on one or more camshafts via respective rocker arms 23 which are accommodated in a rocker box defined by a removable rocker box cover 40.

Figure 2:
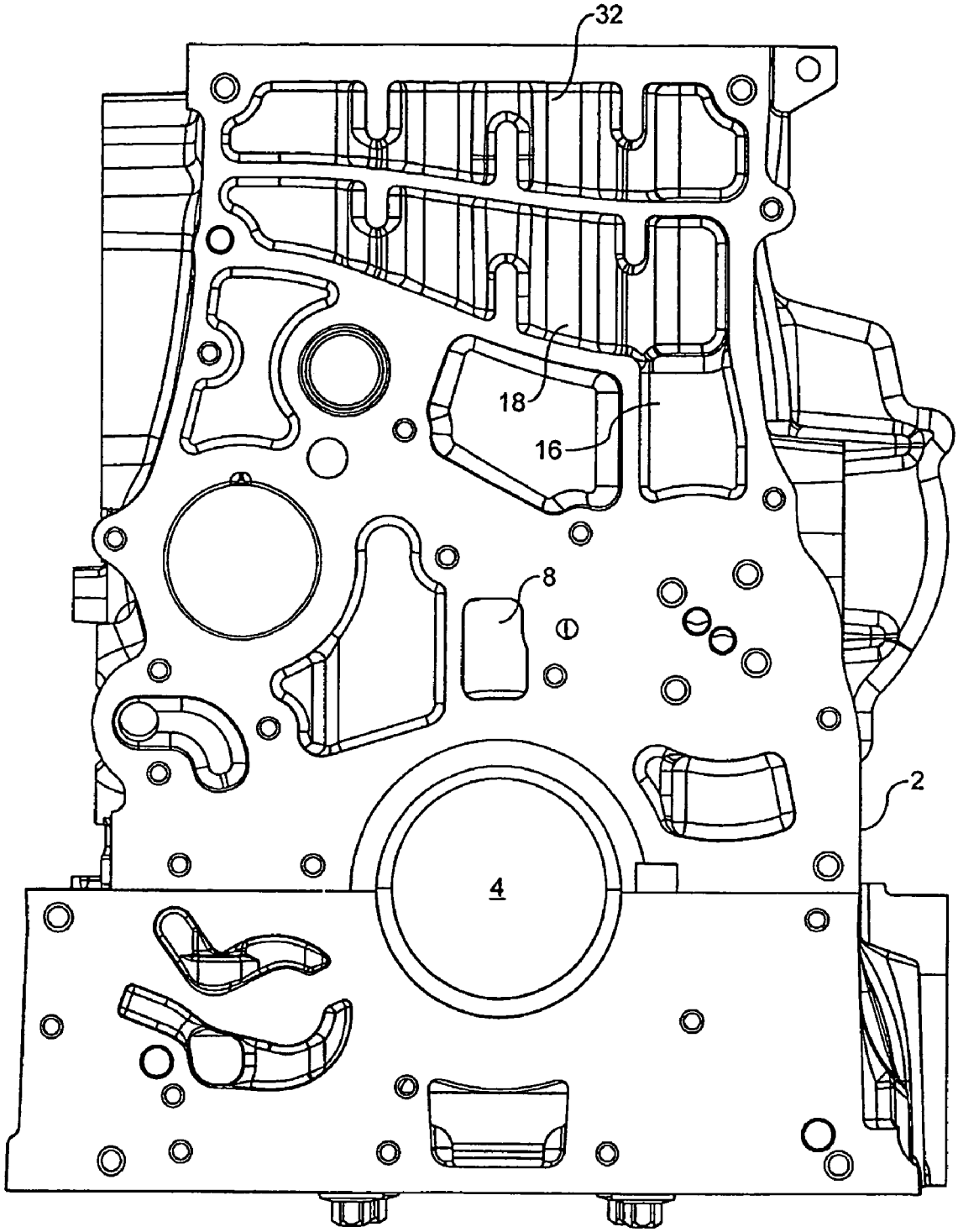
FIG. 2 is a view of the rear end of the cylinder block of the engine.
Figure 3:
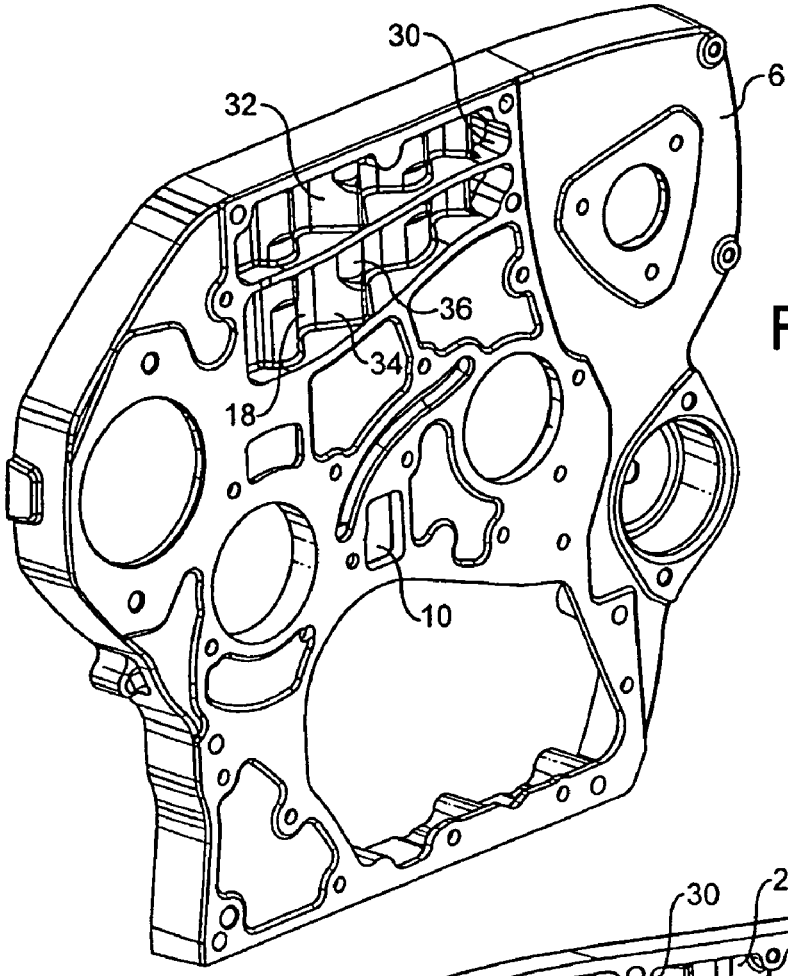
FIG. 3 is a perspective view of the gearcase, seen from the direction of the cylinder block.
Figure 4:
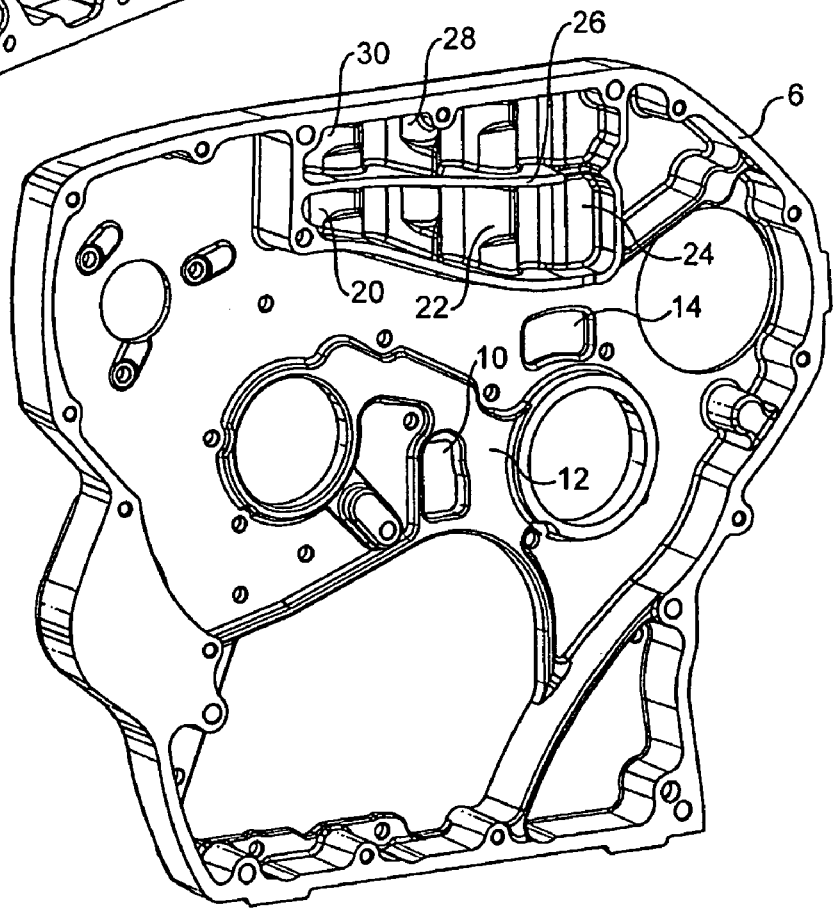
FIG. 4 is a perspective view of the gearcase, seen from the direction of the flywheel.
Figure 5:
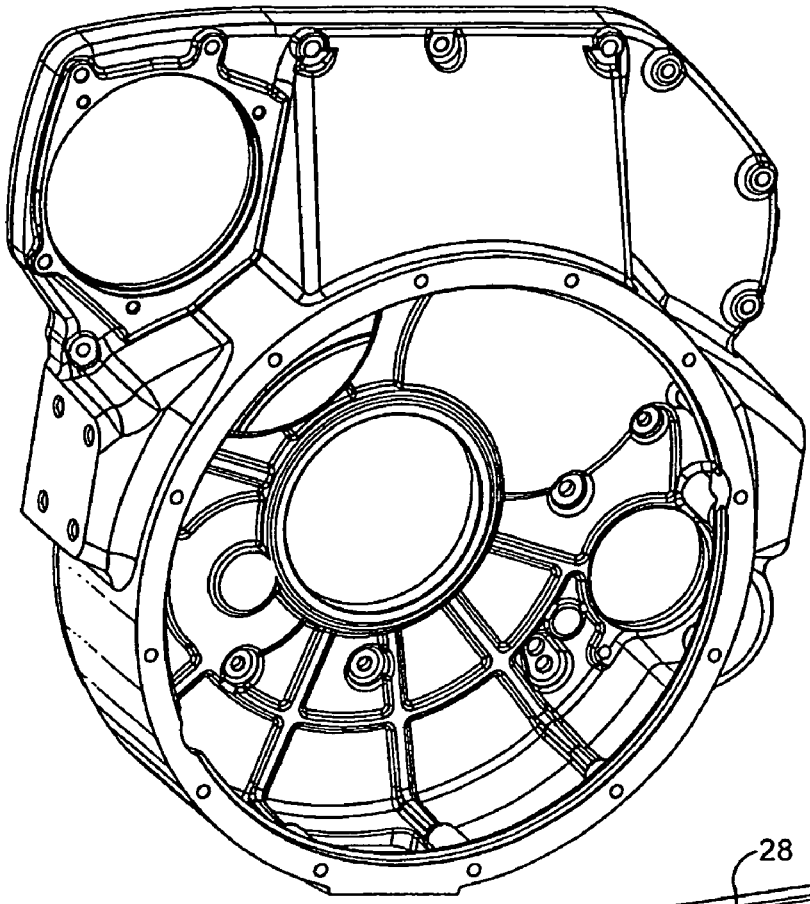
FIG. 5 is a perspective view of the flywheel casing, seen in the direction towards the gearcase.
Figure 6:
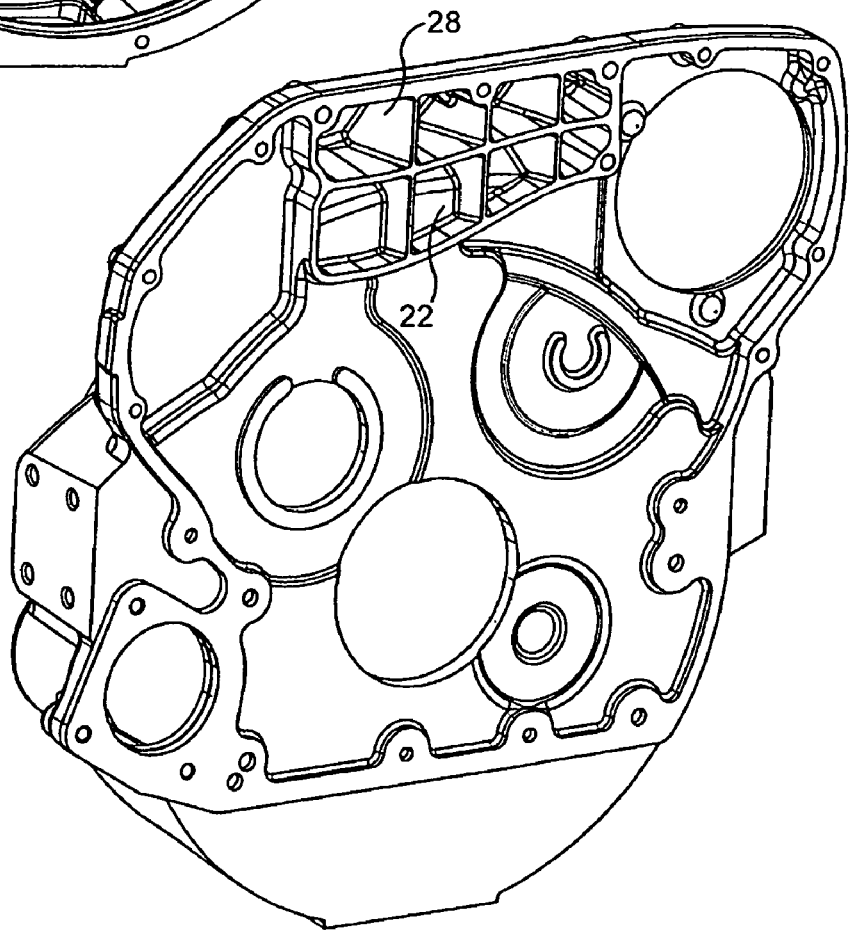
FIG. 6 is a perspective view of the flywheel casing, seen from the direction of the gearcase.

As mentioned above, the crankshaft is accommodated in a crankcase, which is closed at the bottom by a crankcase cover 25. Combustion gases carrying unburnt or partially burnt hydrocarbons in droplet or particulate form leak past the pistons into the crankcase and these so-called blow-by gases are then conducted over a complex pathway back to the inlet manifold. The interior of the crankcase communicates with a passage which opens out through the rear surface of the cylinder block through a hole 8. The hole 8 is in registry with a corresponding hole 10 which extends through the gearcase at a position at which the surface of the gearcase remote from the cylinder block is recessed at 12 and which is situated behind a driven gear. The crankcase gas pathway then passes back through the gearcase through a further hole 14, which is in registry with a recess 16 in the end surface of the cylinder block. The recess 16 communicates with one end of a first labyrinthine droplet separator passage 18 defined between the cylinder block and the gearcase. At the other end of the passage 18, on the left in FIG. 2, the pathway passes through a hole 20 in the gearcase which communicates with one end of a second labyrinthine droplet separator passage 22, which is defined between the gearcase and the flywheel casing and extends from left to right in FIG. 4. The pathway then passes upwardly through a hole 24 in a horizontal web 26 formed on the gearcase. The hole 24 communicates with one end of a third labyrinthine droplet separator passage 28 defined between the gearcase and the flywheel casing. The pathway continues to the left, as seen in FIG. 4, and the right as seen in FIG. 6, and then passes through a further hole 30, which is formed in the gearcase and communicates with one end of a fourth labyrinthine droplet separator passage 32 defined between the gearcase and the cylinder block. The pathway continues to the left, as seen in FIG. 3, and the right, as seen in FIG. 2, and then passes through an exit hole 25 which opens out through the upper surface of the cylinder block.

Each labyrinthine passage is defined between two of the engine block, the gearcase and the flywheel casing. Each of these components has, at the appropriate position, a generally undulating surface comprising spaced ribs 34 defining a series of troughs and peaks in the direction of the length of the crankshaft, the peaks on each component being in registry with the troughs on the other component so that gas flowing along the passage is caused to move in a serpentine path and constantly impinges on the surfaces defining the passage. It will be seen that the passages 18 and 28 are of decreasing cross-sectional area, in the direction of gas flow through them, whilst the passages 22 and 32 are of increasing cross-sectional area and this is found to further enhance the coalescing and agglomeration of oil droplets and other solid particles on the surfaces of the passages and thus to further improve the droplet separation efficiency. All four labyrinthine passages are defined in part by the gearcase which is provided with two relatively thin, elongate undulating surface portions, one above the other, both sides of each of which partially define respective labyrinthine passages.

As may be seen in the Figures, each peak or rib 34 extends further in the direction of the crankshaft at one end than the other. In other words, each rib has a cut-out 36 at one end. Adjacent ribs in the direction of gas flow have their cut-out at alternating ends. Each passage 18, 22, 28, 32 is thus so shaped that gas flowing through it is obliged to flow along a pathway which is serpentine in two perpendicular senses, i.e. parallel and perpendicular, respectively, to the direction of the length of the crankshaft. This yet further enhances the droplet separation efficiency.

The exit hole 25 in the top of the cylinder block is in registry with an entry hole in the underside of the cylinder head, which is connected to the cylinder block in the usual manner. The entry hole communicates with a passage 27 in the cylinder head, the other end of which passage communicates via the interior of the rocker box with the inlet to a further labyrinthine droplet separator provided in the rocker box cover 40.

Figure 7:
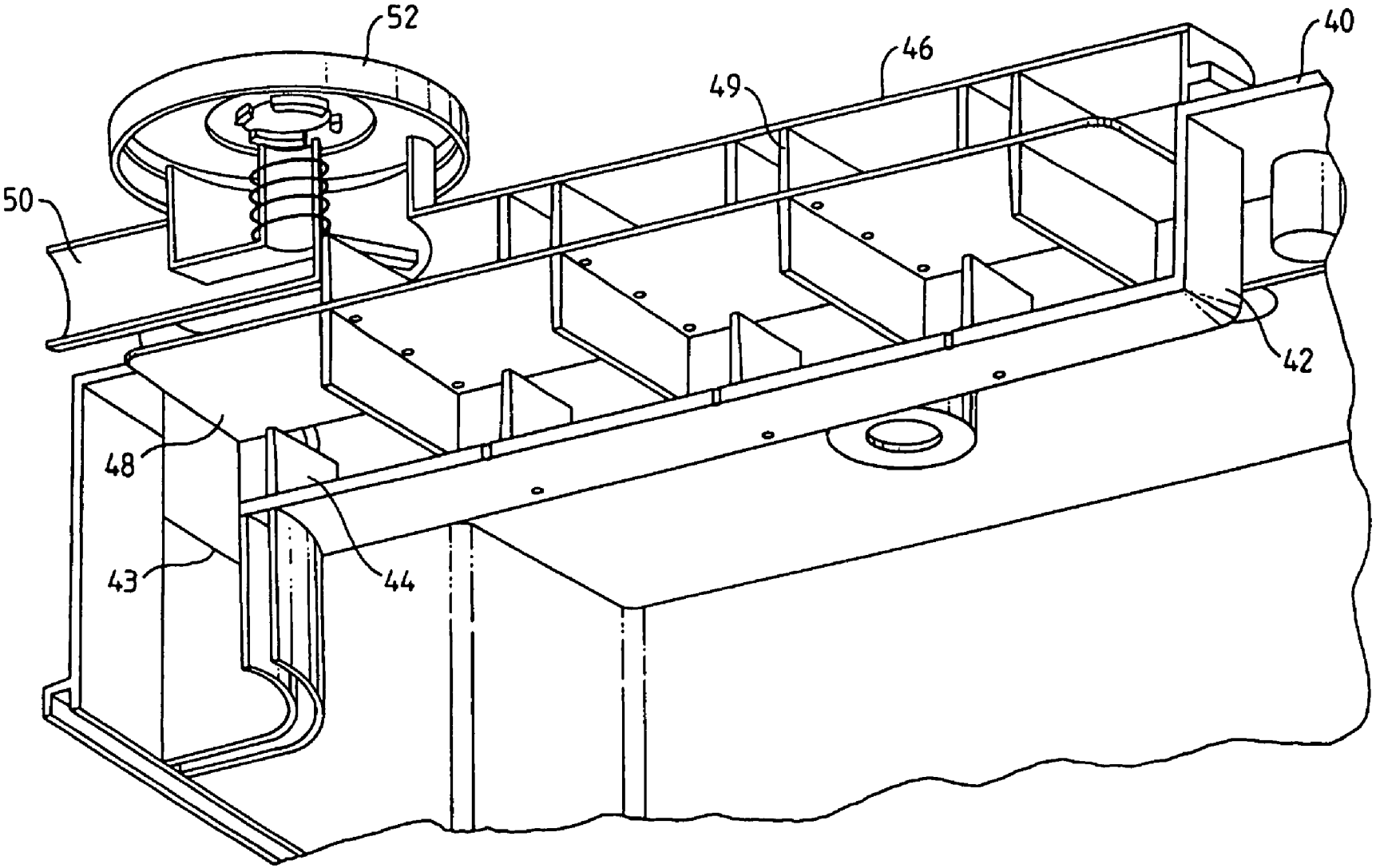
FIG. 7 is a perspective cut-away view of the engine rocker box cover.

The rocker box is best seen in FIG. 7 and is defined by a cover 40 in whose upper surface there is an elongate trough 42. Formed in the base of the trough is a number of small oil return holes and a gas inlet hole 43 and upstanding from the base of the trough is a number of ribs 44 spaced apart in the direction of the length of the trough. Removably received in the trough is a separator unit 46, depending from whose underside is a plurality of spaced ribs 48 parallel to but offset from the ribs 44. Formed in the underside of the unit 46 at the end remote from the gas inlet hole 43 is a further hole communicating with the interior of the unit 46. Formed in the interior of the unit is a plurality of ribs or baffles 49, each of which extends between the top and bottom of the interior space but terminates short of one of its sides to leave a gap. The gaps of adjacent baffles 49 are on alternate sides. Thus the space between the base of the unit 46 and the base of the trough 42 constitutes a labyrinthine passage which is serpentine in the vertical direction and communicates with a further passage inside the unit 46 which is serpentine in the lateral direction. The passage within the unit 46 communicates with an outlet pipe 50 via a minimum pressure or non-return valve 52 (omitted from FIG. 1). The outlet pipe 50 is connected to the engine inlet manifold. The purpose of the valve 52 is to ensure that the crankcase is always slightly pressurised. If the crankcase gas pathway were connected directly to the inlet manifold, the sub-atmospheric pressure of the manifold would be applied to the crankcase and contamination could gain access to the crankcase.

Thus, when the engine is in operation, blow-by gases entering the crankcase pass out of the rear surface of the crankcase through the holes 8 and 10 and impinge against the rear surface of one of the driven gears. The region behind this driven gear is relatively quiescent and this impingement results in a proportion of the entrained droplets coalescing and thus being removed from the gas. The coalesced droplets are flung off the driven gear as a result of its rapid rotation and impinge against the interior of the gearcase and then drip down and are returned to the sump. The gas then flows sequentially through the labyrinthine passages 18, 22, 28 and 32 and the complex shapes of these passages combined with their changes in cross-sectional area and the abrupt changes of direction as the gas flows from one passage to the next results in substantially all the remaining entrained droplets coalescing against the surfaces of the passages. These coalesced droplets are again returned to the sump through apertures, which are not shown, and are defined in the gaskets between the gearcase and the cylinder block and flywheel casing. These gaskets may be applied in liquid form and the apertures may be formed by locally relieving one or other of the opposed surfaces, e.g. as at 31 in FIG. 1, whereby a discontinuity or aperture in the gasket is formed. The blow-by gas, now largely uncontaminated by entrained droplets, then flows into the interior of the rocker box and then through the second two-stage labyrinthine separator which removes substantially all the remaining entrained droplets. Those further droplets which are removed coalesce and drip through the oil return holes provided in the base of the separator unit 46 and the base of the trough 42 into the rocker box. The minimum pressure valve 52 ensures that the entire pathway and thus the crankcase are maintained at a small super-atmospheric pressure at all times. The gas then flows into the inlet manifold and takes part in the combustion process. Any minimal amount of oil droplets still remaining are combusted in the engine and it is found in practice that this amount is so small that it results in a negligible increase in emissions, such as smoke, in the exhaust gases of the engine.

The invention claimed is:

1. An internal combustion engine including a cylinder block defining a plurality of cylinders reciprocably accommodating respective pistons, which are connected by respective connecting rods to a common crankshaft, which is accommodated in a crankcase, each cylinder communicating with a common inlet manifold via one or more inlet valves, the crankcase communicating with the inlet manifold via a pathway which includes a droplet separator comprising a labyrinthine pathway, the crankshaft carrying a drive gear, which is in mesh with a plurality of driven gears accommodated in a gearcase, which is connected to one end of the cylinder block, whereby the crankcase and the gearcase have adjacent opposed surfaces, wherein the labyrinthine pathway is defined at least in part by the said opposed surfaces of the crankcase and the gearcase.

2. An engine as claimed in claim 1 in which the labyrinthine pathway includes at least two elongate passage portions connected in series, the gas flow directions through the two passage portions being parallel but opposite.

3. An engine as claimed in claim 1 in which the interior of the crankcase communicates with the droplet separator via a hole in the crankcase, wherein the hole is positioned in registry with one of the gears therein.

4. An internal combustion engine including a cylinder block defining a plurality of cylinders reciprocably accommodating respective pistons, which are connected by respective connecting rods to a common crankshaft, which is accommodated in a crankcase, each cylinder communicating with a common inlet manifold via one or more inlet valves, the crankcase communicating with the inlet manifold via a pathway which includes a droplet separator comprising a labyrinthine pathway, the crankshaft carrying a drive gear, which is in mesh with a plurality of driven gears accommodated in a gearcase, which is connected to one end of the cylinder block, the crankshaft also carrying a flywheel, which is accommodated in a flywheel casing connected to the gearcase, whereby the crankcase and the gearcase have adjacent opposed surfaces, wherein the labyrinthine pathway is defined at least in part by the said opposed surfaces of the crankcase and the gearcase, whereby the flywheel casing and the gearcase have opposed surfaces, wherein the labyrinthine pathway is also defined in part by the said opposed surfaces of the flywheel casing and the gearcase.

5. An engine as claimed in claim 4 in which the labyrinthine pathway includes four passage portions connected in series, two of which are defined between the cylinder block and the gearcase and the other two of which are defined between the flywheel casing and the gearcase.

6. An engine as claimed in claim 4 in which the droplet separator communicates with the interior of the crankcase via one or more oil return holes formed in a gasket provided between at least one of the gearcase and the cylinder block and the flywheel casing.

7. An engine as claimed in claim 5 in which the gearcase affords two elongate undulating regions which define alternating peaks and troughs in the directions both towards and away from the cylinder block, each undulating region partially defining a respective two of the four passage portions.

8. An internal combustion engine including a cylinder block defining a plurality of cylinders reciprocably accommodating respective pistons, which are connected by respective connecting rods to a common crankshaft, which is accommodated in a crankcase, each cylinder communicating with a common inlet manifold via one or more inlet valves, the crankcase communicating with the inlet manifold via a pathway which includes a droplet separator comprising a labyrinthine pathway, the crankshaft carrying a drive gear, which is in mesh with a plurality of driven gears accommodated in a gearcase, which is connected to one end of the cylinder block, the crankshaft also carrying a flywheel accommodated in a flywheel casing, which is connected to the gearcase, whereby the flywheel casing and the gearcase have adjacent opposed surfaces, wherein the labyrinthine pathway is defined at least in part by the said opposed surfaces of the flywheel casing and the gearcase.

9. An engine as claimed in claim 1 in which the inlet valves cooperate with respective rocker arms accommodated in a common rocker box defined by a cover and the pathway includes a further labyrinthine droplet separator which forms part of the cover.

10. An engine as claimed in claim 9 in which the pathway communicates with the interior of the rocker box and formed in the rocker box cover is a trough, whose interior communicates with the interior of the rocker box and formed on the base of which is a plurality of upstanding ribs and received in which is a separator unit, the base of which together with the base of the trough defines a first gas passage and depending from the base of which is a plurality of ribs offset from the upstanding ribs, whereby the first gas passage is serpentine and constitutes at least part of the further labyrinthine droplet separator.

11. An engine as claimed in claim 10 in which the first gas passage communicates with the interior of the separator unit which defines a second gas passage in which a plurality of baffles is so arranged that the second gas passage is also serpentine, the baffles in the second gas passage being inclined to the ribs in the first gas passage by substantially 90°.

12. An internal combustion engine including a cylinder block defining a plurality of cylinders reciprocably accommodating respective pistons, which are connected by respective connecting rods to a common crankshaft, which is accommodated in a crankcase, each cylinder communicating with a common inlet manifold via one or more inlet valves, the crankcase communicating with the inlet manifold via a pathway which includes a droplet separator comprising a labyrinthine pathway, the pathway also including one or more minimum pressure valves, which are configured to maintain the pathway and the crankcase at a small superatmospheric pressure at all times, the crankshaft carrying a drive gear, which is in mesh with a plurality of driven gears accommodated in a gearcase, which is connected to one end of the cylinder block, whereby the crankcase and the gearcase have adjacent opposed surfaces, wherein the labyrinthine pathway is defined at least in part by the said opposed surfaces of the crankcase and the gearcase.

* * * * *